US010607797B2

(12) United States Patent
Zuniga

(10) Patent No.: US 10,607,797 B2
(45) Date of Patent: Mar. 31, 2020

(54) ELECTRICAL SWITCH WITH IDENTIFICATION FEATURES

(71) Applicant: Melissa Zuniga, Nowthen, MN (US)

(72) Inventor: Melissa Zuniga, Nowthen, MN (US)

( * ) Notice: Subject to any disclaimer, the term of this patent is extended or adjusted under 35 U.S.C. 154(b) by 163 days.

(21) Appl. No.: 15/813,822

(22) Filed: Nov. 15, 2017

(65) Prior Publication Data

US 2018/0137999 A1 May 17, 2018

Related U.S. Application Data

(60) Provisional application No. 62/422,274, filed on Nov. 15, 2016, provisional application No. 62/554,665, filed on Sep. 6, 2017.

(51) Int. Cl.
*H01H 23/02* (2006.01)
*H01H 23/14* (2006.01)

(52) U.S. Cl.
CPC ..... *H01H 23/025* (2013.01); *H01H 23/141* (2013.01); *H01H 2219/002* (2013.01); *H01H 2221/016* (2013.01)

(58) Field of Classification Search
CPC ..... H01H 23/025; H01H 23/141; H01H 2219/002
USPC ..... 200/309
See application file for complete search history.

(56) References Cited

U.S. PATENT DOCUMENTS 3,250,887 A 5/1966 Sorenson
4,234,774 A 11/1980 Paparella
5,008,503 A 4/1991 Stuhlmacher
6,013,885 A * 1/2000 Kowalczyk ..... H01H 23/025 200/302.3
7,329,018 B2 2/2008 Yu et al.
8,253,049 B2 8/2012 Grisby
8,338,731 B2 12/2012 Yu
8,592,681 B2 11/2013 Alderson et al.
8,822,859 B2 9/2014 Hoffman et al.
9,082,569 B2 7/2015 Alderson et al.
2004/0218379 A1 11/2004 Barton
2010/0170773 A1 7/2010 Grisby
2014/0097070 A1* 4/2014 McDonnell ..... H01H 9/18 200/308

(Continued)

OTHER PUBLICATIONS

International Search Report and Written Opinion for PCT Application No. PCT/US2019030603, dated Jul. 17, 2019, 12 pages.

*Primary Examiner* — Edwin A. Leon
*Assistant Examiner* — Iman Malakooti
(74) *Attorney, Agent, or Firm* — Patterson Thuente Pedersen, P.A.

(57) ABSTRACT

An electrical switch with identifying features. Embodiments include a toggle assembly for an electrical switch that comprises a switch body including a contact mechanism configured to control an electrical circuit. A movement of the toggle assembly from a first position to a second position is mechanically communicated to the contact mechanism. The toggle assembly can also include a user-operable actuator portion elongated between the switch engagement portion and a front end of the toggle assembly enabling a user to pivot the toggle assembly from the first position to the second position. Embodiments include an interchangeable tile removably coupleable to the toggle. The interchangeable tile can comprise an identifier. Embodiments include an illuminating element.

18 Claims, 7 Drawing Sheets

(56) References Cited

U.S. PATENT DOCUMENTS

| | | | | |
|---|---|---|---|---|
| 2014/0151203 | A1* | 6/2014 | Gouhl | H01H 23/146<br>200/303 |
| 2014/0265883 | A1 | 9/2014 | Mortun | |

* cited by examiner

ELECTRICAL SWITCH WITH IDENTIFICATION FEATURES

CROSS-REFERENCE TO RELATED APPLICATIONS

This application claims the benefit of U.S. Provisional Application No. 62/422,274, filed Nov. 15, 2016, and U.S. Provisional Application No. 62/554,665, filed Sep. 6, 2017, the disclosures of which are herein incorporated by reference.

TECHNICAL FIELD

Embodiments of the present disclosure relate generally to the field of electrical switches, specifically electrical switches adapted for use in building wiring.

BACKGROUND

In many building environments, lights, electrical outlets, and other devices are controlled by a series of electrical switches, often referred to as "light switches." For convenience, these switches are often arranged on panels with two or more switches in close proximity. Individual switches on panels are often generic, leading to user confusion regarding which electrical device(s) are controlled by any particular switch.

A variety of labeling options for switch plates exist, ranging from permanently labeled plates to removable adhesive labels. However, in many environments, switch plate designs are decorative, and labels incorporated into switch plates can be intrusive.

A need exists therefore, for electrical switches that enable identification of the electrical device(s) and/or circuits that they are configured to control.

SUMMARY

Embodiments of the present disclosure include light switches with identifying labeling. In embodiments, a user facing surface of an electrical switch includes an identifying symbol on an interchangeable tile.

Embodiments of the present invention include a toggle assembly for an electrical switch that comprises a switch body including a contact mechanism configured to control an electrical circuit. The toggle assembly can comprise a switch engagement portion proximate and operably coupled to the switch body at a rear end of the toggle assembly, such that a movement of the toggle assembly from a first position to a second position is mechanically communicated to the contact mechanism. The toggle assembly can also include a user-operable actuator portion elongated between the switch engagement portion and a front end of the toggle assembly enabling a user to pivot the toggle assembly from the first position to the second position. Embodiments include an interchangeable tile removably coupleable to the actuator portion at the front end of the toggle assembly.

In embodiments, the interchangeable tile comprises a user-comprisable identifier on a front surface of the interchangeable tile, such that the interchangeable tile indicates a property, such as the intended function, of the electrical circuit controlled by the electrical switch.

In embodiments, the interchangeable tile comprises a connection mechanism at a rear surface of the interchangeable tile and the actuator portion comprises a receiving mechanism at a front surface of the actuator portion. The connection mechanism and the receiving mechanism are configured to provide removable fixation between the interchangeable tile and the actuator portion.

In embodiments, the connection mechanism can be a rearward directed pin, and the receiving mechanism comprises a slot of a diameter sufficient to receive the pin. In embodiments, the connection mechanism can be a rearward directed threaded screw, and the receiving mechanism comprises a threaded bore configured to receive the screw. In embodiments the connection mechanism can include one or more flanges extending along an axis parallel to the front surface of the connection mechanism, and the receiving mechanism comprises one or more grooves configured to receive the one or more flanges.

In embodiments, the toggle assembly an also include an illuminating element, such as a light-emitting diode (LED). In embodiments, a conductive trace can electrically couple the illuminating element to the electrical circuit controlled by the electrical switch, such that the illuminating element is powered by the electrical circuit. In embodiments, a power source independent of the electrical circuit can power the illuminating element is powered by the power source. In embodiments, the interchangeable tile is at least partially made of a light-transmitting material, such that light generated by the illuminating element can be seen at a front surface of the interchangeable tile. The actuator portion can be made of an opaque material, such that light generated by the illuminating element cannot be seen through the actuator portion.

In another aspect, embodiments of the present disclosure include an electrical switch to control an electrical circuit. The electrical switch can include a switch body comprising a first terminal for electrical connection to a first lead of the electrical circuit, a second terminal for electrical connection to a second lead of the electrical circuit, a contact mechanism including a contact point electrically coupled to the first terminal, a lever arm electrically coupled to the second terminal. The lever arm can be manipulable to selectively contact the contact point. The switch can also include a toggle assembly including a switch engagement portion proximate and operably coupled to the switch body at a rear end of the toggle assembly, such that when the toggle assembly is in a first position the lever arm is not in contact with the contact point, and when the toggle assembly is in a second position, the lever arm is in contact with the contact point. The toggle assembly can also include a user-operable actuator portion elongated between the switch engagement portion and a front end of the toggle assembly enabling a user to pivot the toggle assembly from the first position to the second position, and an interchangeable tile removably coupleable to the actuator portion at the front end of the toggle assembly.

In another aspect, embodiments of the present disclosure can include a kit for providing an indication of a function of an electrical switch. The kit can include an electrical switch with a switch body including a contact mechanism configured to control an electrical circuit, a toggle, and a plurality of interchangeable tiles. The toggle can be pivotable between a first position and a second position, and operably coupled to the switch body at a rear end of the switch body and include a user-operable actuator portion extending from the rear end to a front end of the toggle. Each can be interchangeable tile removably coupleable to the actuator portion at the forward end of the toggle.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures.

Figure 1:
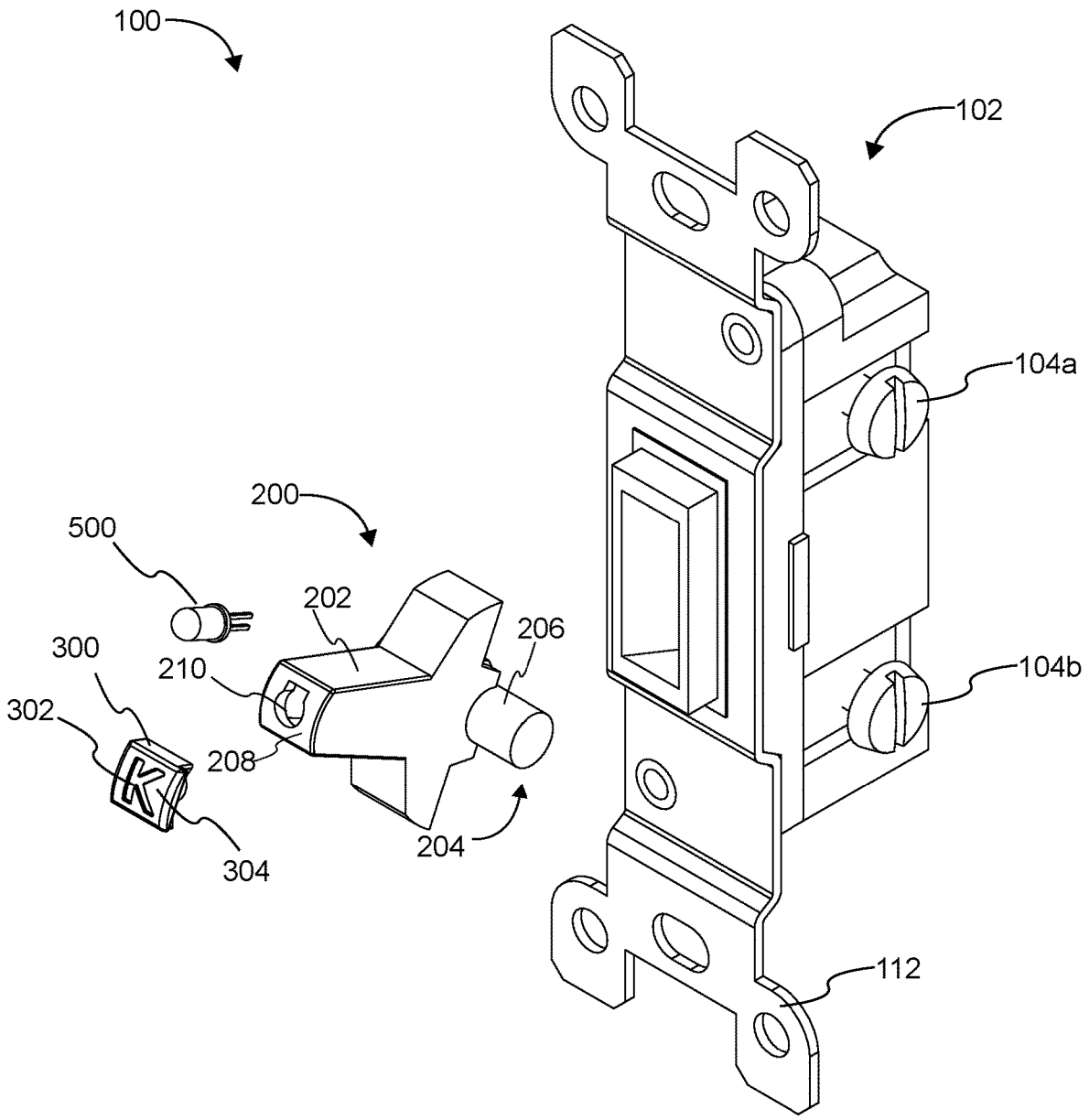
FIG. 1 is an exploded perspective view depicting an electrical switch, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

FIG. 1 is an exploded perspective view of an embodiment of an electrical switch 100. Electrical switch 100 includes toggle 200, which is operably coupleable to interchangeable tile 300. In embodiments tile 300 and toggle 200 can be combined into a toggle assembly. Light switch 100 can enable a user to control an electrical circuit via manipulation of toggle 200. In embodiments, the electrical circuit can include one or more lighting devices, electrical outlets, other devices, or combinations of these.

Switch 100 can comprise switch body 102. Switch body 102 can have form, dimensions, materials, and structure similar to conventional electrical switches capable of receiving toggle 200. Switch body 102 can two or more comprise terminals 104 for connection to leads of an electrical circuit. As depicted herein, switch 100 is a single-pole light switch including terminals 104*a* and 104*b* for connection to electrical wiring. Embodiments of light switch 100 can be three-way or four-way switches, and may include more terminals 104, including one or more grounding terminals in order to support environments in which multiple switches may control an electrical circuit.

Figure 2A:
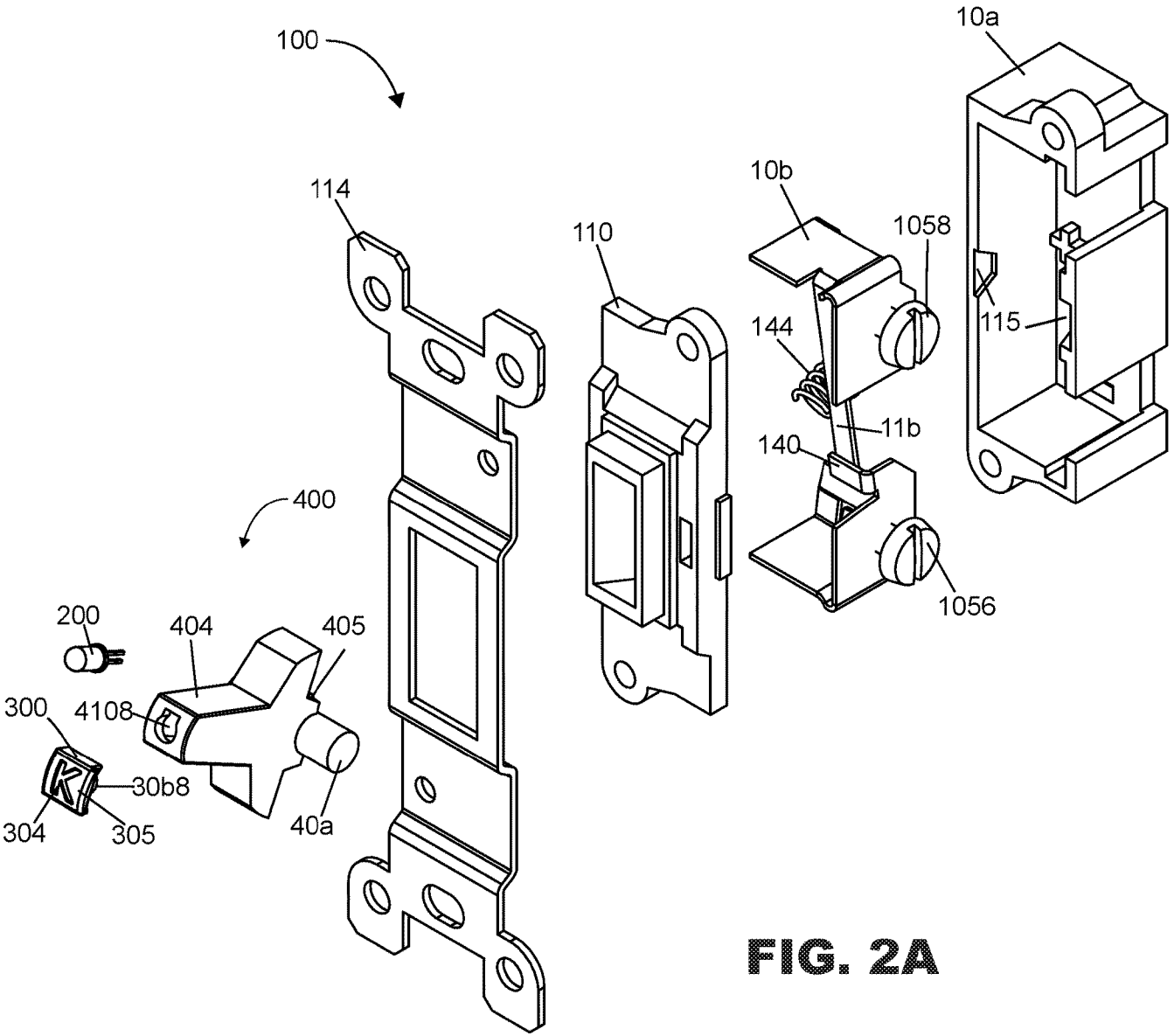
FIG. 2A is an exploded perspective view depicting the electrical switch of FIG. 1.
Figure 2B:
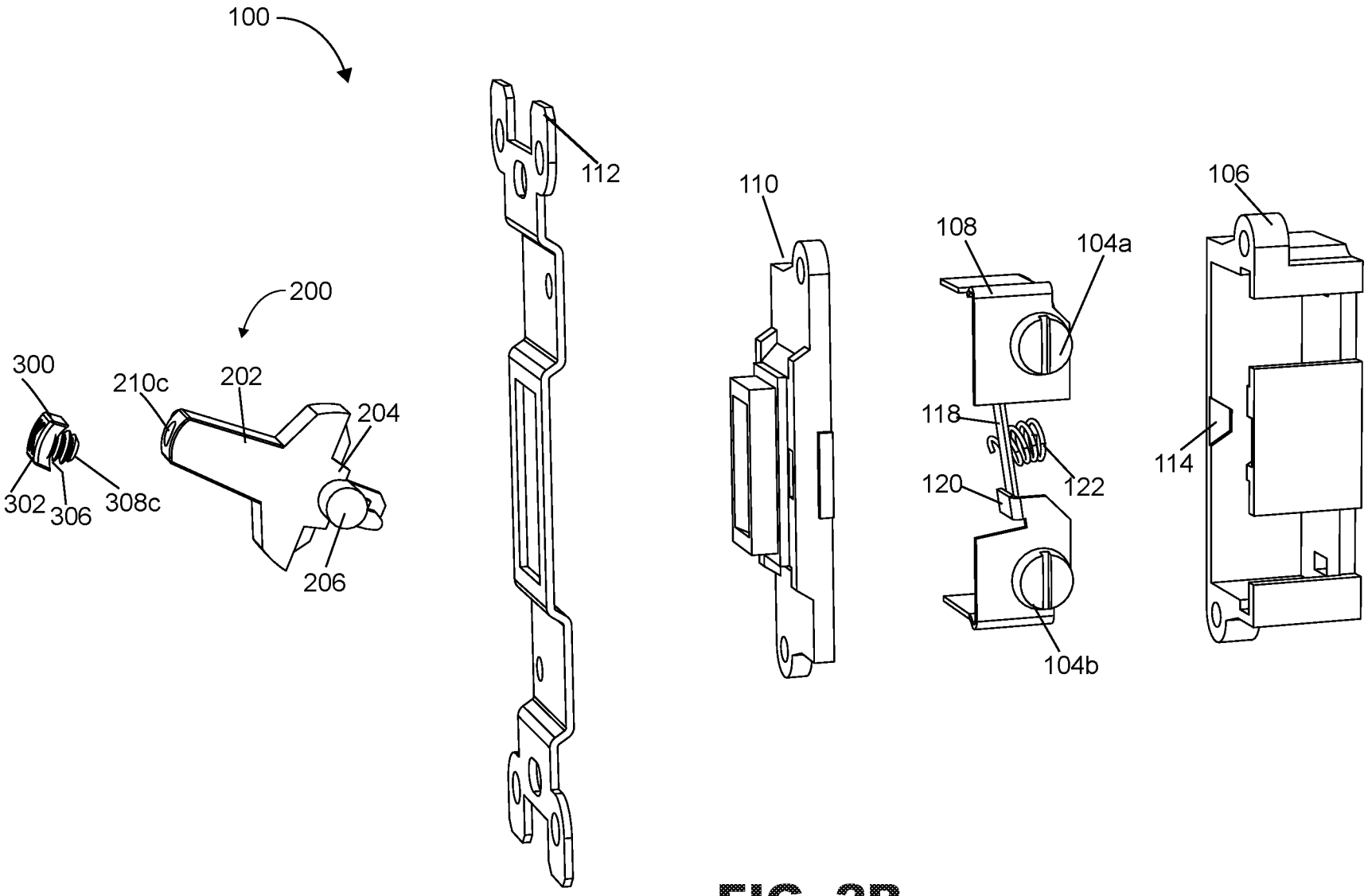
FIG. 2B is an exploded perspective view depicting an electrical switch, according to an embodiment.

FIGS. 2A and 2B are exploded perspective views of switch 100, according to an embodiment. In the depicted embodiment, switch body 102 further comprises housing 106, contact assembly 108, guard plate 110 and mounting plate 112. In embodiments, switch body 102 can have dimensions according to those depicted in FIGS. 3A and 3B. Those of ordinary skill in the art will appreciate that the configuration of switch body 102 depicted and described herein is a particular example, and various alternative configurations can be used, especially those adapted to local electrical standards or codes.

Housing 106 can comprise pivot cradles 114. Contact assembly 108 can comprise contact mechanism 116 to selectively electrically couple one or more terminals 104. In an embodiment, contact mechanism 116 can comprise a lever arm 118 operatively coupled to a first terminal 104*a* and a contact point 120 operably coupled to a second terminal 104*b*. Lever arm 118 can be spring-loaded, flexible, or otherwise manipulable such that inward pressure on lever arm 118 can break contact between lever arm 118 and contact point 120. Contact assembly can further comprise spring 122. Those of ordinary skill in the art will recognize that other configuration of contact mechanism 116 can be used.

Toggle 200 can comprise user-operable actuator portion 202 and switch engagement portion 204. Switch engagement portion 204 can comprise one or more pivot pins 206, enabling a front end 208 of toggle 200 to pivot in an arc (centered at pivot pins 206) from a first position to a second position within switch body 102 by movement of user-operable actuator portion 202. Switch engagement portion 204 can further comprise one or more features, such as a ram, button, piston, protrusion, or other, configured to selectively engage a contact mechanism (see FIG. 2A) of switch body 102. User-operable actuator portion 202 can comprise receiving mechanism 210 to receive interchangeable tile 300.

As assembled, pivot pins 206 can engage with pivot cradles 114 such that actuator portion 202 extends forward through contact assembly 108, guard plate 110, and mounting plate 112. Actuator portion 202 can project outward from switch body 102 for a length of about 19/32 inches, though other lengths can be used.

Interchangeable tile 300 can be permanently or removably coupleable to user-operable actuator portion 202. Interchangeable tile 300 can comprise a user-comprisable identifier 302 on a front surface 304. User-comprisable identifier 302 is depicted as the letter "K" herein, but can comprise, any letter, number, character, pictogram, icon, other symbol, pattern, color, or other marker or identifier capable of assisting in identification. In embodiments, tile 300 can comprise a material that temporarily or permanently markable with various substances including permanent ink, dry-erase ink, chalk, graphite, crayon, or other mark-making material.

In embodiments, tile 300 can present a square cross section, with a length and width between about 1/8 inches and about 3/8 inches. In embodiments, tile 300 can present a cross section of alternative shape or dimensions, including a shape coordinated with front end 208 of toggle 200. Tile 300 can have a rear surface 306 configured to correspond to the front end 208 of toggle 200. Front end 208 and rear surface 306 can be substantially curved as depicted, flat, angled, smooth, rough, or present other shapes or textures as desired.

In embodiments, identifier 302 can be molded into front surface 304 of tile 300. Identifier 302 can be raised into a high relief or sunken into bas-relief relative to front surface 304, in embodiments. In embodiments, identifier 302 may present as an aperture or bore extending from front surface 304 to rear surface 306 of interchangeable tile 300.

Tile 300 can comprise a connection mechanism 308, configured to engage with a receiving mechanism 210 of toggle 200. As depicted in FIGS. 1 and 2A, receiving mechanism 210 comprises structure of toggle 200 defining a slot 210*a* of size and shape (such as width, diameter, length, height, or other dimension) to receive connection mechanism 308 which comprises a pin 308*a*. Pin 308*a* and slot 210*a* can comprise keyed structures, such that tile 300 is limited to a particular orientation when coupled to toggle 200.

Figure 3B:
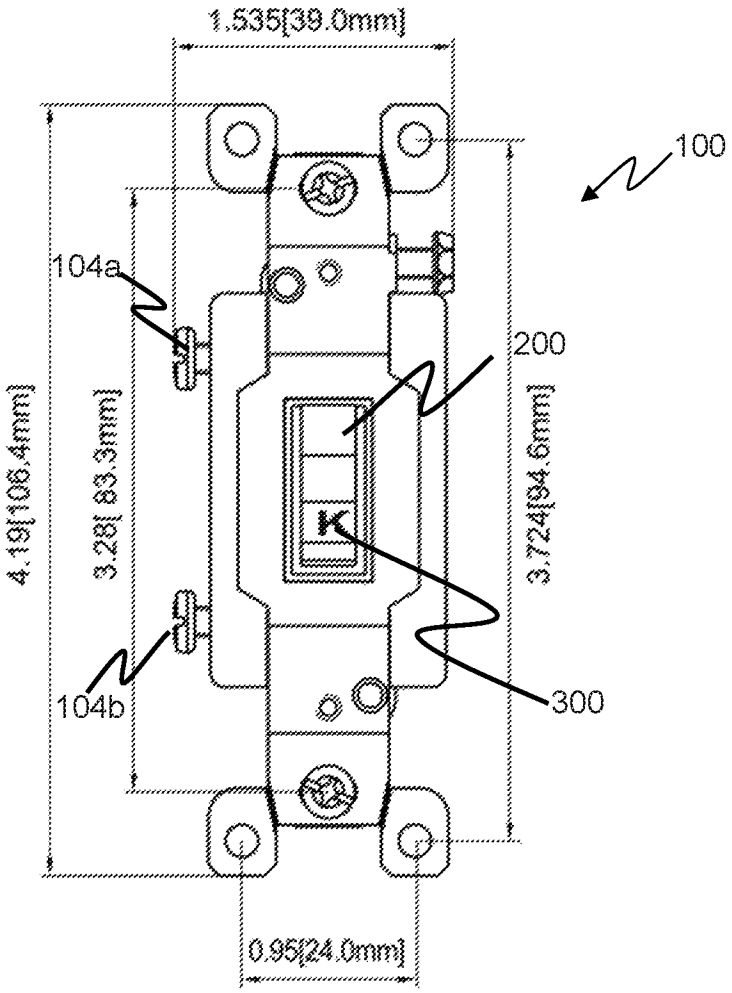
FIG. 3B is a front plan view depicting the electrical switch of FIG. 3A.
Figure 3A:
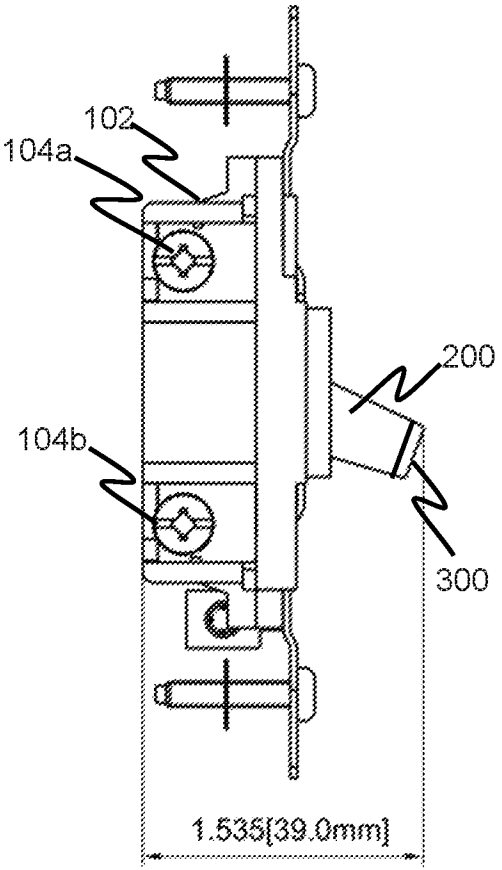
FIG. 3A is a side plan view depicting an electrical switch, according to an embodiment.
Figure 4A:
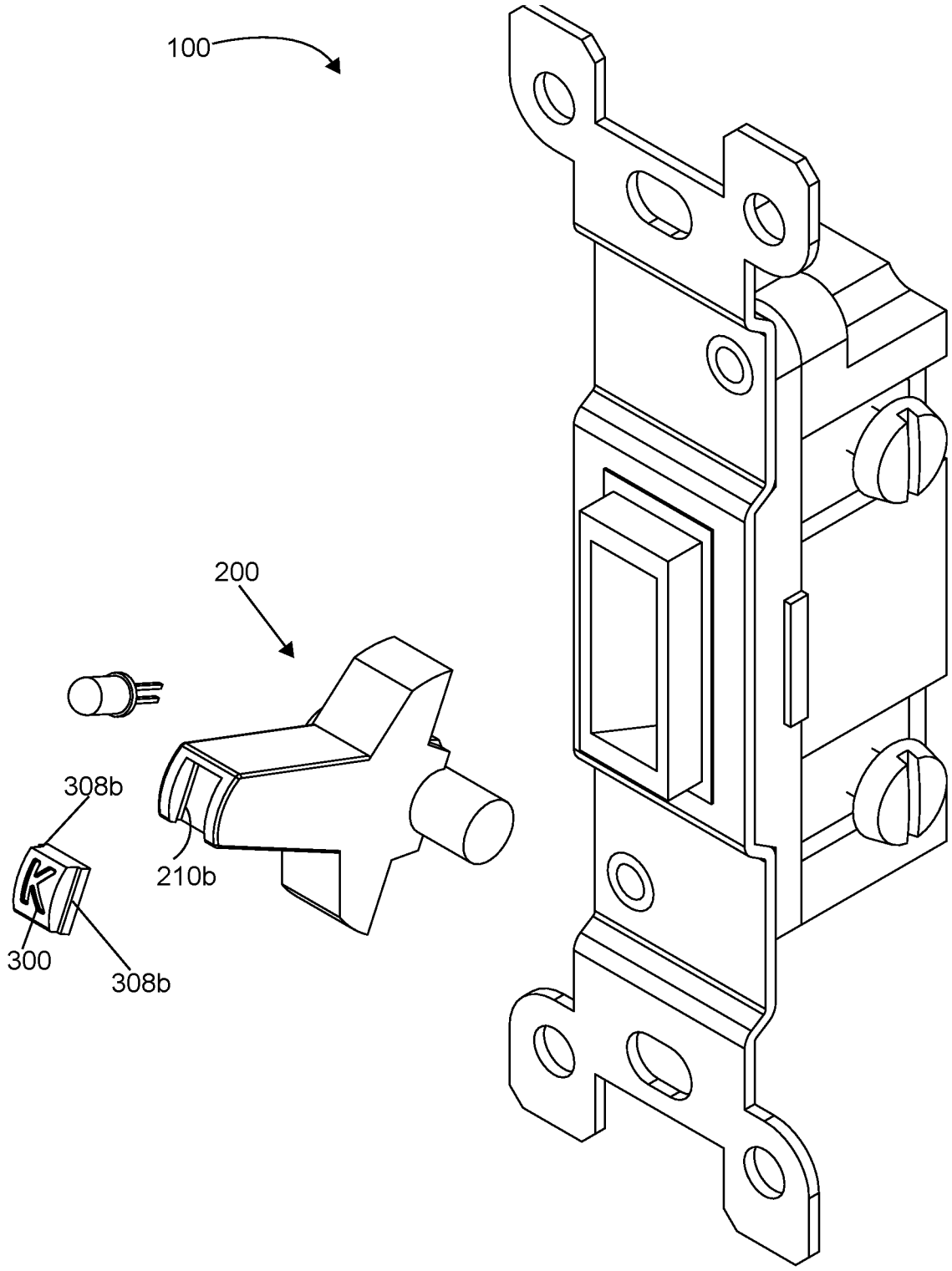
FIG. 4A is an exploded perspective view depicting an electrical switch, according to an embodiment.
Figure 4B:
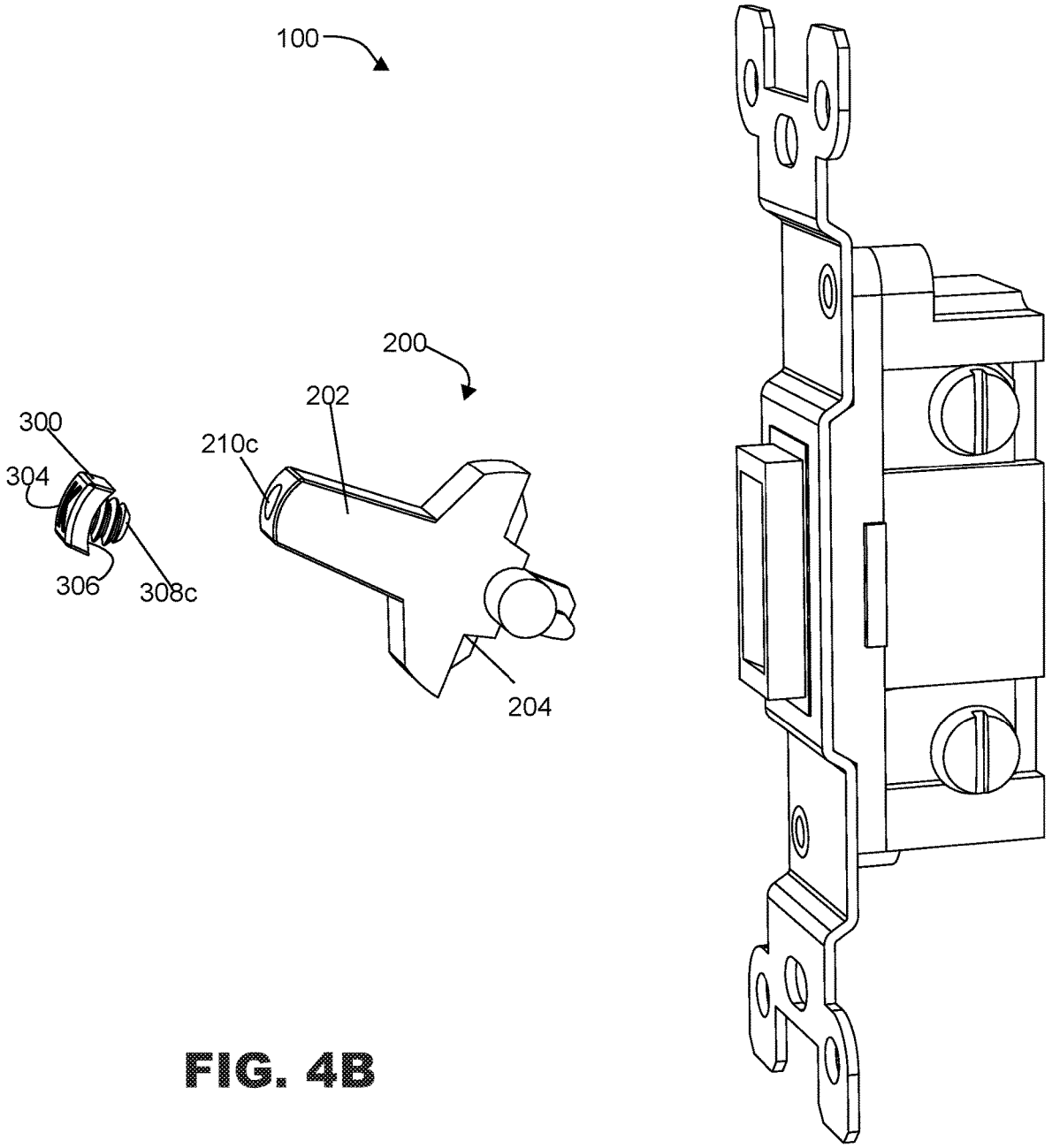
FIG. 4B is an exploded perspective view depicting an electrical switch, according to an embodiment.
Figure 4C:
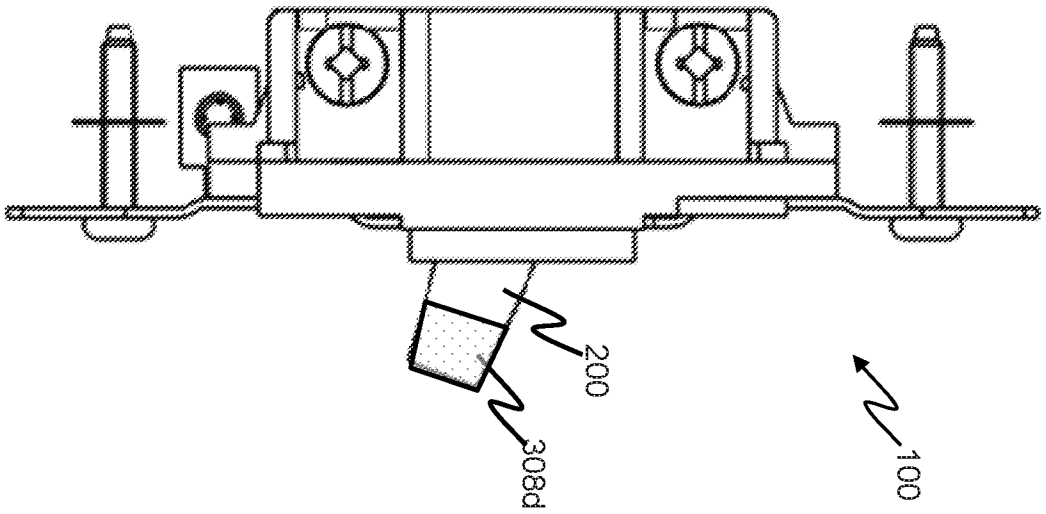
FIG. 4C is a side plan view depicting an electrical switch, according to an embodiment.

FIGS. 3A-3C are exploded perspective views depicting embodiments of switch 100 including alternative connection methods between tile 300 and toggle 200. In FIG. 3A, tile 300 comprises flanges 308*b*, configured for slideable engagement with grooves 210*b* of toggle 200. Grooves 210*b* can, as depicted, extend partially along a surface of toggle 200 at front end 208, such that flanges 308*b* are prevented from sliding out of grooves 210*b*. Grooves 210*b* are depicted such that tile 300 is inserted from a bottom end of switch 100, however in embodiments grooves 210*b* and flanges 308*b* can be arranged such that tile 300 is inserted from a bottom, top, left, or right side of toggle 200.

FIG. 3B depicts tile 300 comprising threaded pin or screw 308*c*. Toggle 200 can comprise coordinating threaded bore 210*c*. Tile 300 can be rotated by a user such that screw 308*c* engages bore 210*c* to removably couple tile 300 to toggle 200. FIG. 3C depicts tile 300 comprising a cover 308*d*. Cover 308*d* is configured to extend along toggle 200 towards switch body 102. Receiving mechanism 210*d* can comprise a convention toggle tip, or textured material to provide additional engagement with cover 308*d*. In embodiments, cover 308*d* can be constructed of an elastomeric material such as silicone or latex, and can be stretched to fit over toggles of one or more sizes and configurations.

In embodiments, connection mechanism 308 and receiving mechanism 210 can be removably affixed via pressure, or friction fit between corresponding components. In alternative embodiments, each of connection mechanism 308 and receiving mechanism 210 can further comprise compatible adhesive surfaces. Adhesive surfaces can comprise temporary removable adhesives or permanent adhesives in embodiments.

While multiple connection mechanisms 308 and receiving mechanisms 210 are depicted and described herein, those of ordinary skill in the art will recognize that other connection methods can be used, including male and female snap connectors, hook-and-loop connectors, magnetic connectors or any other connectors enabling removable or permanent connection between tile 300 and toggle 200.

Returning now to FIG. 1, in embodiments, switch 100 can further comprise illuminating element 500. Illuminating element 500 can be a light emitting diode (LED) or other light source capable of generating light without causing excess power draw or heating of switch 100. Illuminating element 500 can draw power from an independent battery or other power source in embodiments. In embodiments, illuminating element 500 can be electrically coupled to terminals by one or more conductive traces (not shown) to draw power from the circuit controlled by switch.

In embodiments, illuminating element 500 can comprise a multi-element LED, such as the red-green-blue (RGB) LEDs described in U.S. Pat. No. 8,339,058 to Simmers, or other light source capable of emitting light of various colors. In embodiments, illuminating element 500 can be factory configured to display a specific color. In embodiments, switch 100 can include a configuration mechanism adapted to enable user selection of the color or intensity of illuminating element 500. In an embodiment, the configuration mechanism can comprise one or more switches, dials, or jumpers, enabling a user to determine whether illuminating element 500 will be illuminated, and if so the relative intensity of each element of a multi-element LED in order to determine the color. In an embodiment, the configuration mechanism can comprise a wired or wireless connection to a control device (such as a computer, mobile phone, table, remote control, or other device) adapted to send control signals that are interpreted by configuration mechanism to modify the operating parameters of illuminating element 500.

In embodiments, toggle 200 and tile 300 can be constructed of hard plastic or other material suitable to allow operation of switch 100. In embodiments, all or parts of toggle 200 and tile 300 can be opaque, translucent, or transparent, in order to allow light emitted from illuminating element 500 to be seen through all or a portion of toggle 200 and tile 300. Switch body 102 can be constructed of a variety of materials as are generally known in the art for the construction of electrical switches.

While switch 100 has been depicted and described as a toggle switch, in embodiments of the present disclosure switch 100 can be configured as a rocker switch, dimmer switch, push button switch, or other electrical switch configuration known in the art.

In embodiments, one or more switches 100 can be provided in a kit comprising multiple interchangeable tiles 300, such that the identifier 302 displayed on switch 100 can be selected when the switch is installed. For example, in one embodiment, a kit can comprise a single switch 100, or toggle 200, and multiple tiles 300. In embodiments, a kit can comprise multiple switches arranged in a gang panel configuration (such as a one-, two-, three-, or higher gang switch) and multiple identifiers.

In embodiments, tiles 300 can be provided in sets based on commonly grouped switch types. For example, a set can include identifiers for common household rooms such as kitchen, living room, dining room, and bedroom. Other sets can include identifiers for example, for overhead lights, floor lights, or audio appliances. Tiles 300 can further be provided in sets corresponding to the alphabet of the English language (or other languages), Arabic numbers (1-10) or with a combination of colors, patterns, shapes or other designs.

In use, tiles 300 can provide an identifier related to the electrical circuit controlled by switch 100, such that the user can more easily distinguish the purpose of multiple switches 100 within a single area.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A toggle assembly for an electrical switch comprising a switch body including a contact mechanism configured to control an electrical circuit, the toggle assembly comprising:

a switch engagement portion proximate and operably coupled to the switch body at a rear end of the toggle assembly, such that a movement of the toggle assembly from a first position to a second position is mechanically communicated to the contact mechanism;

a user-operable actuator portion elongated between the switch engagement portion and a front end of the toggle assembly enabling a user to pivot the toggle assembly from the first position to the second position; and an interchangeable tile removably coupleable to the actuator portion at the front end of the toggle assembly by a connection mechanism selected from the group consisting of a rearward directed pin, a rearward directed threaded screw, and one or more flanges extending along an axis parallel to the front surface of the connection mechanism.

2. The toggle assembly of claim 1, wherein the interchangeable tile comprises a user-comprisable identifier on a front surface of the interchangeable tile, such that the interchangeable tile indicates a property of the electrical circuit controlled by the electrical switch.

3. The toggle assembly of claim 1, wherein the interchangeable tile comprises a connection mechanism at a rear surface of the interchangeable tile and the actuator portion comprises a receiving mechanism at a front surface of the actuator portion; and further wherein the connection mechanism and the receiving mechanism are configured to provide removable fixation between the interchangeable tile and the actuator portion.

4. The toggle assembly of claim 3, wherein the connection mechanism comprises a rearward directed pin, and the receiving mechanism comprises a slot of a diameter sufficient to receive the pin.

5. The toggle assembly of claim 3, wherein the connection mechanism comprises a rearward directed threaded screw, and the receiving mechanism comprises a threaded bore configured to receive the screw.

6. The toggle assembly claim 3, wherein the connection mechanism comprises one or more flanges extending along an axis parallel to the front surface of the connection mechanism, and the receiving mechanism comprises one or more grooves configured to receive the one or more flanges.

7. The toggle assembly of claim 1, further comprising an illuminating element.

8. The toggle assembly of claim 7, wherein the illuminating element comprises a light-emitting diode.

9. The toggle assembly of claim 7, further comprising an conductive trace electrically coupling the illuminating element to the electrical circuit controlled by the electrical switch, such that the illuminating element is powered by the electrical circuit.

10. The toggle assembly of claim 7, further comprising a power source independent of the electrical circuit, such that the illuminating element is powered by the power source.

11. The toggle assembly of claim 7, wherein the interchangeable tile at least partially comprises a light-transmitting material, such that a light generated by the illuminating element can be seen at a front surface of the interchangeable tile.

12. The toggle assembly of claim 7, wherein the actuator portion comprises an opaque material, such that a light generated by the illuminating element cannot be seen through the actuator portion.

13. An electrical switch to control an electrical circuit comprising:

a switch body including— a first terminal for electrical connection to a first lead of the electrical circuit, a second terminal for electrical connection to a second lead of the electrical circuit, a contact mechanism including— a contact point electrically coupled to the first terminal, and a lever arm electrically coupled to the second terminal, the lever arm manipulable to selectively contact the contact point;

a toggle assembly including— a switch engagement portion proximate and operably coupled to the switch body at a rear end of the toggle assembly, such that when the toggle assembly is in a first position the lever arm is not in contact with the contact point, and when the toggle assembly is in a second position, the lever arm is in contact with the contact point, a user-operable actuator portion elongated between the switch engagement portion and a front end of the toggle assembly enabling a user to pivot the toggle assembly from the first position to the second position, and an interchangeable tile removably coupleable to the actuator portion at the front end of the toggle assembly by a connection mechanism selected from the group consisting of a rearward directed pin, a rearward directed threaded screw, and one or more flanges extending along an axis parallel to the front surface of the connection mechanism.

14. The electrical switch of claim 13, wherein the interchangeable tile comprises a user-comprisable identifier on a front surface of the interchangeable tile, such that the interchangeable tile indicates a property of the electrical circuit controlled by the electrical switch.

15. The electrical switch of claim 13, wherein the interchangeable tile comprises a connection mechanism at a rear surface of the interchangeable tile and the actuator portion comprises a receiving mechanism at a front surface of the actuator portion; and further wherein the connection mechanism and the receiving mechanism are configured to provide removable fixation between the interchangeable tile and the actuator portion.

16. The electrical switch of claim 13, wherein the toggle assembly further comprises an illuminating element.

17. A kit for providing an indication of a function of an electrical switch, the kit comprising:

an electrical switch comprising— a switch body including a contact mechanism configured to control an electrical circuit;

a toggle, pivotable between a first position and a second position, and operably coupled to the switch body at a rear end of the switch body, the toggle comprising— a user-operable actuator portion extending from the rear end to a front end of the toggle; and a plurality of interchangeable tiles, each interchangeable tile removably coupleable to the actuator portion at the front end of the toggle by a connection mechanism selected from the group consisting of a rearward directed pin, a rearward directed threaded screw, and one or more flanges extending along an axis parallel to the front surface of the connection mechanism.

18. The kit of claim 17, wherein each of the plurality of interchangeable tiles comprises a user-comprisable identifier on a front surface of the interchangeable tile, such that the interchangeable tile indicates a property of the electrical circuit controlled by the electrical switch.

* * * * *